US010708986B2

(12) United States Patent
Wiggins et al.

(10) Patent No.: US 10,708,986 B2
(45) Date of Patent: Jul. 7, 2020

(54) DEVICE FOR AND METHOD OF MICROWAVE HEATING WITH INVERSION

(71) Applicant: Dart Industries Inc., Orlando, FL (US)

(72) Inventors: James Michael Wiggins, Pleasant Hill, CA (US); Johan Carrette, Brussels (BE); Nathalie Roiret, Villepreaux (FR)

(73) Assignee: Dart Industries Inc., Orlando, FL (US)

( * ) Notice: Subject to any disclaimer, the term of this patent is extended or adjusted under 35 U.S.C. 154(b) by 242 days.

(21) Appl. No.: 15/967,725

(22) Filed: May 1, 2018

(65) Prior Publication Data

US 2019/0342955 A1 Nov. 7, 2019

(51) Int. Cl.

| | |
|---|---|
| ***H05B 6/80*** | (2006.01) |
| ***H05B 6/64*** | (2006.01) |
| ***B65D 81/34*** | (2006.01) |

(52) U.S. Cl.

CPC ..... *H05B 6/6494* (2013.01); *B65D 81/3453* (2013.01); *H05B 6/6408* (2013.01); *B65D 2581/344* (2013.01)

(58) Field of Classification Search

CPC ..... H05B 6/64; H05B 6/6402; H05B 6/6408; H05B 6/6494; H05B 6/80; B65D 81/3446; B65D 81/3453; B65D 81/3853; B65D 2581/344; B65D 2581/3408; B65D 2581/3416; B65D 2581/3443; B65D 2581/3447; B65D 2581/3456; B65D 2581/3458; B65D 2581/3472; B65D 2581/3477; B65D 2581/3479; B65D 2581/3487; B65D 2581/3494; B65D 2581/3498

USPC ..... 219/725, 730, 732, 734, 735, 759, 733

See application file for complete search history.

(56) References Cited

U.S. PATENT DOCUMENTS

| | | | | |
|---|---|---|---|---|
| 4,911,938 | A | 3/1990 | Fisher et al. | |
| 4,927,991 | A | 5/1990 | Wendt et al. | |
| 5,045,660 | A | 9/1991 | Levinson | |
| 5,247,149 | A | 9/1993 | Peleg | |
| 5,343,024 | A | 8/1994 | Prosise et al. | |
| 8,026,464 | B2 | 9/2011 | Romeo et al. | |
| D661,943 | S | 6/2012 | Pallotto et al. | |
| 8,901,469 | B2 | 12/2014 | Schneider et al. | |
| 2007/0029316 | A1* | 2/2007 | Fernandez | A47J 36/027 219/730 |
| 2009/0206075 | A1* | 8/2009 | Lafferty | H05B 6/6494 219/734 |

(Continued)

*Primary Examiner* — Hung D Nguyen

(74) *Attorney, Agent, or Firm* — Taylor J. Ross

(57) ABSTRACT

A device for microwave heating with inversion has a base and a cover defining a heating chamber. Both the base and the cover include a susceptor heatable by microwave energy and the cover includes an aperture to vent steam. With a food product in the heating chamber, the device is placed in a microwave oven resting on the base. During an initial heating period, the lower surface of the food product is browned or crisped due to conduction and steam escapes from the heating chamber via the aperture. After the initial heating period, the device in inverted and the food product comes into contact with the cover. The device is placed in the microwave oven resting on the cover during a secondary heating period in which the food product is heated further, and the upper surface of the food product is browned or crisped due to conduction.

16 Claims, 4 Drawing Sheets

(56) References Cited

U.S. PATENT DOCUMENTS

2018/0035494 A1 2/2018 Barea et al.

* cited by examiner

DEVICE FOR AND METHOD OF MICROWAVE HEATING WITH INVERSION

CROSS REFERENCE TO RELATED APPLICATIONS

This application is related to co-pending Attorney Docket No. 132048-D200 which is incorporated herein by reference.

STATEMENT REGARDING FEDERALLY SPONSORED RESEARCH

Not applicable.

BACKGROUND OF THE INVENTION

The present invention relates in general to devices and methods for reheating or cooking foods in a microwave oven, including baking. It is known that direct application of microwave energy to most food items provides less than desired heating or cooking outcomes, such as spotty heating, lack of browning, etc. To solve this, it has been known to provide microwave containers with susceptors which convert microwave energy into heat energy.

It is common for such devices to brown only the portion of the food in contact with the container. It is also common for such devices to produce food which is undesirably soggy (too high moisture content).

SUMMARY OF THE INVENTION

An object of the present invention is to provide a device and method for heating food in a microwave oven with improved browning or crisping Another object of the present invention is to provide such a device and method including inversion for full browning and crisping.

A further object of the present invention is to provide such a device which includes apertures in the cover for venting.

These and other objects are achieved by a device for and method of microwave heating with inversion.

BRIEF DESCRIPTION OF THE DRAWINGS

The objects and features of the invention noted above are explained in more detail with reference to the drawings, in which like reference numerals denote like elements, and in which.

DETAILED DESCRIPTION OF THE INVENTION

Figure 1:
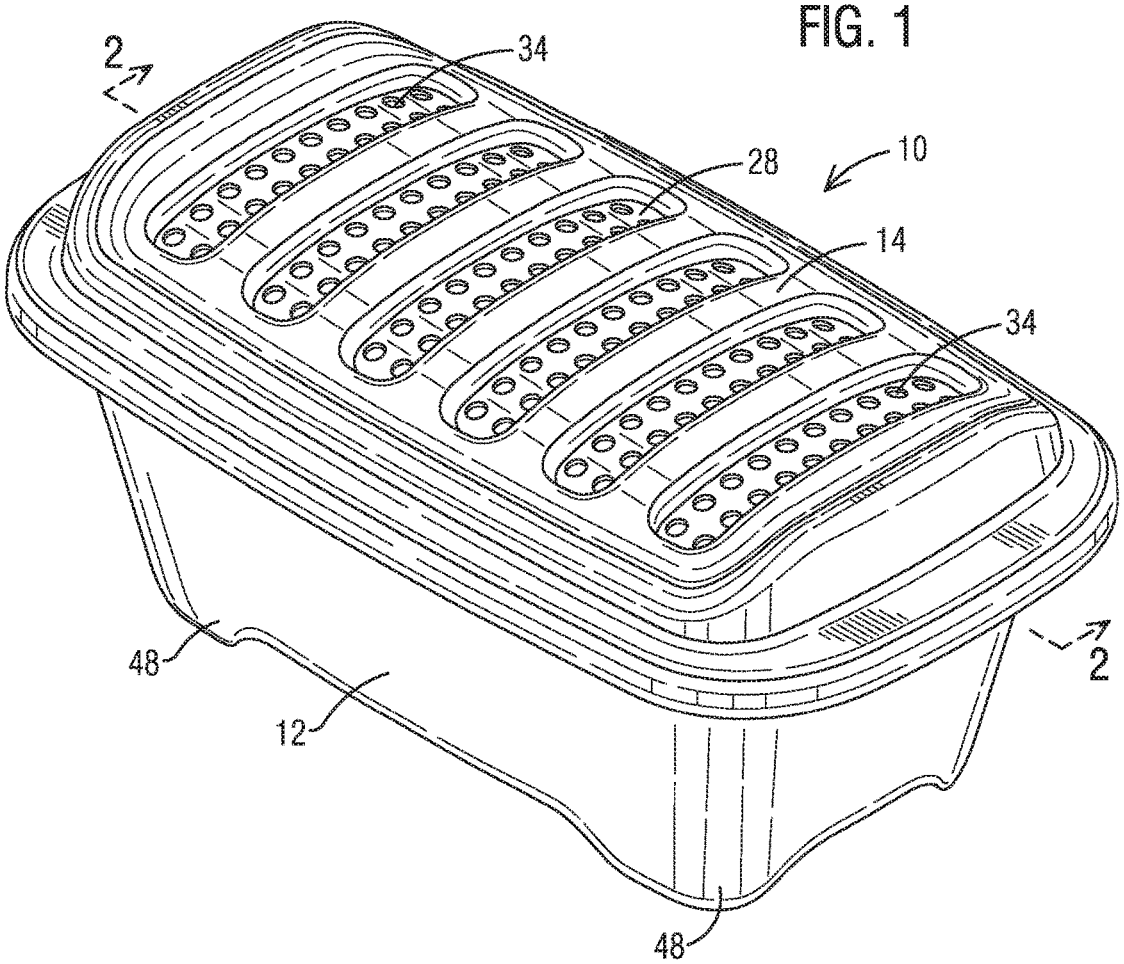
FIG. 1 is a top perspective view of a first embodiment of a device for microwave heating with inversion.
Figure 2:
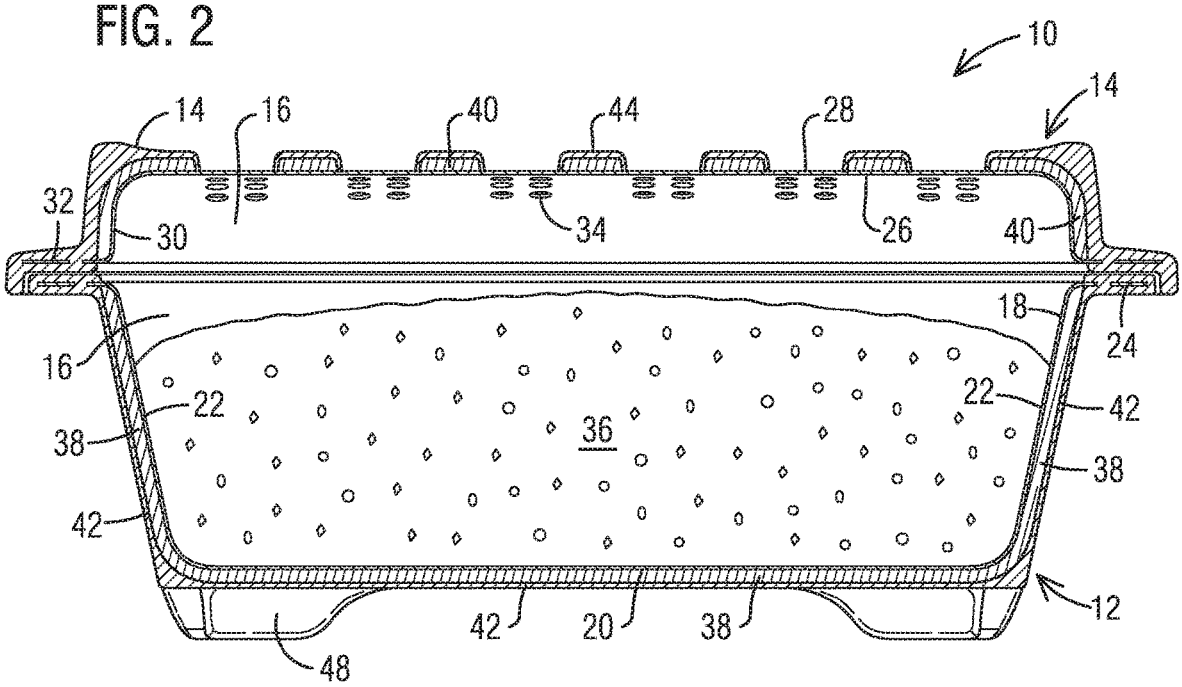
FIG. 2 is a side cross-sectional view along line 2-2 of FIG. 1.

With reference to FIG. 1, a device for microwave heating with inversion according to the present invention is generally designated by reference numeral 10. The device 10 generally includes base 12 and a cover 14 together defining a heating chamber 16 (FIG. 2). The device 10 is sized to be received within a microwave oven (not shown), which is preferably a home appliance but could be a commercial appliance.

The device 10 may be formed to substantially eliminate the entry of microwave energy into heating chamber 16, and to cook purely with thermal energy. To this end the base 12 includes a base core 18 having a general concave (upward) shape including a bottom face 20 and at least one side wall 22 extending from the periphery of the bottom face 20. The device 10 could alternatively have a round bottom face 20 with a single side wall 22 similar to a cake pan, or other shapes as desired. In this embodiment the base core is formed of drawn metal and as such will form a shield against microwaves. In the embodiment shown, there are four side walls 22 and the base core 18 is sized and shaped as a small loaf pan, and preferably includes a non-stick interior finish. The side walls 22 end at an upper rim, and it is preferred that a flange 24 extend radially outward from the upper rim.

Similarly, the cover 14 includes a cover core 26 having a top face 28 and at least one side wall 30 extending from the periphery of the top face 28. The side walls 30 end at a lower rim, and it is preferred that a flange 32 extend radially outward from the upper rim. The cover 14 is sized and shaped such that it's lower rim will substantially match the upper rim of base 12 to form the enclosed heating chamber 16. The cover core 26 is (in this embodiment) also formed of drawn metal. In this embodiment directed toward baking bread, the top face 28 is slightly domes as shown.

The base core 18 and cover core 26 are respectively heated by a base susceptor 38 and a cover susceptor 40. As is known in the art, susceptors may be formed by metallic powder disbursed through an appropriate matrix. In this first embodiment, the susceptors 38 and 40 are both formed by metallic particles suspended within an elastomer, and overmolded onto the outer face (opposite the food contact) of each of the base core 18 and cover core 26. In the first embodiment the base susceptor 38 coats the entirety of the bottom face 20 and side walls 22 of the base core 18, all the way to the flange 24. The base susceptor 38 could, however, take other forms depending upon the heat generated by the susceptor and the heat transfer of the base core 18. The coating could be partial, in the form of a grid, as dots, as stripes, etc.

Figure 3:
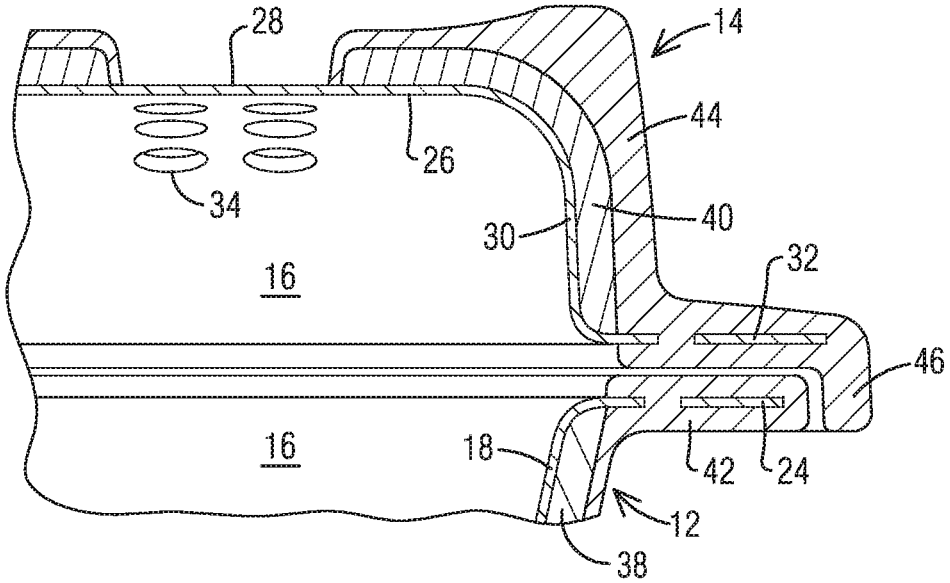
FIG. 3 is detail of the cross-section of FIG. 2.

To protect the base susceptor 38 and prevent contamination of food product 36, it is preferred to overmold the base susceptor 38 with a base coating 42 formed of a durable material such as an elastomer. This may be overmolded onto the base susceptor 38. In the embodiment shown, the base coating 42 is also overmolded to encapsulate the flange 24. This will provide an insulated grasping area which will remain cooler than the flange 24 of base core 18. As best illustrated in FIG. 3, the flange may include spaced cut-outs about its periphery such that the base coating 42 flows through to lock the base coating 42 in place.

In a similar manner the cover core 26 will have the cover susceptor 40 overmolded onto its outer face, and a cover coating 44 overmolded on the cover susceptor 40. Before this is described further, an important aspect of the present invention is the presence of a plurality of apertures 34 extending through the top face 28 of cover core 26. These apertures 34 will allow communication between the heating chamber 16 and atmosphere, and in particular will allow steam to exit the heating chamber 16. The steam will originate from moisture within a food product 36 in the heating chamber 16 and/or from condensation (liquid or frozen) on the food 36 or heating chamber 16. During baking the moisture must be allowed to vent, otherwise the cake, bread or other baked product will not properly dry during baking. Similarly, frozen food being reheated may have frozen condensation on the food, or within the device 10, which will create steam during heating and must be vented to avoid too moist a product, or may simply have a high moisture content which is best reduced before consumption. The apertures 34 extend through only the top face 28 to ensure adequate room for food product 36 to rise during baking. That is, the apertures 34 should not be places so low on the device 10 that the partially cooked food product 36 might unduly extend into or through one or more apertures 34.

Because the device 10 is intended for use in a microwave, the size of the apertures 34 in the cover core 26 becomes important. In particular, the cover core 26 is (in these first two embodiments) intended to shield the heating chamber from microwaves. The apertures 34 will not breach this shielding so long as their diameter is smaller than the wavelength of the microwaves. As such, in these first two embodiments the apertures 34 will have such a small diameter so as to shield against microwaves entering heating chamber 16. This is not required, and particular heating requirements may result in a portion of the apertures 34 having a sufficiently large diameter to allow a portion of the microwave energy to enter the heating chamber 16 and thus food product 36.

Figure 4:
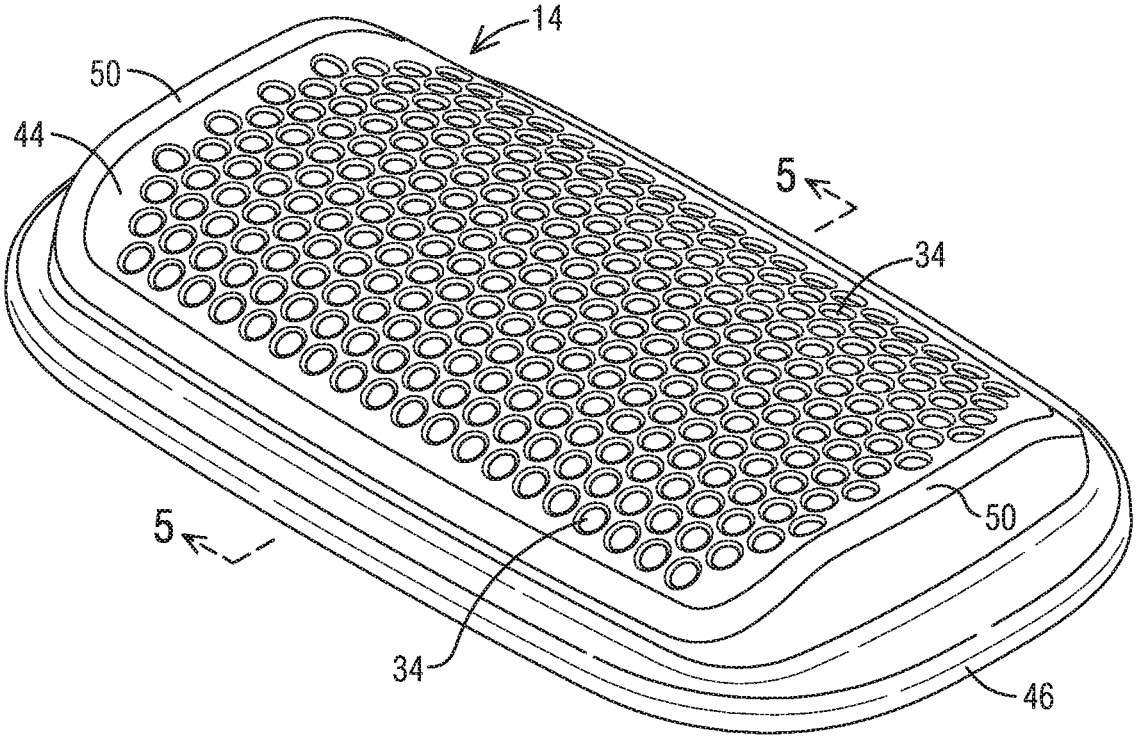
FIG. 4 is a top perspective view of a cover according to a second embodiment.
Figure 5:
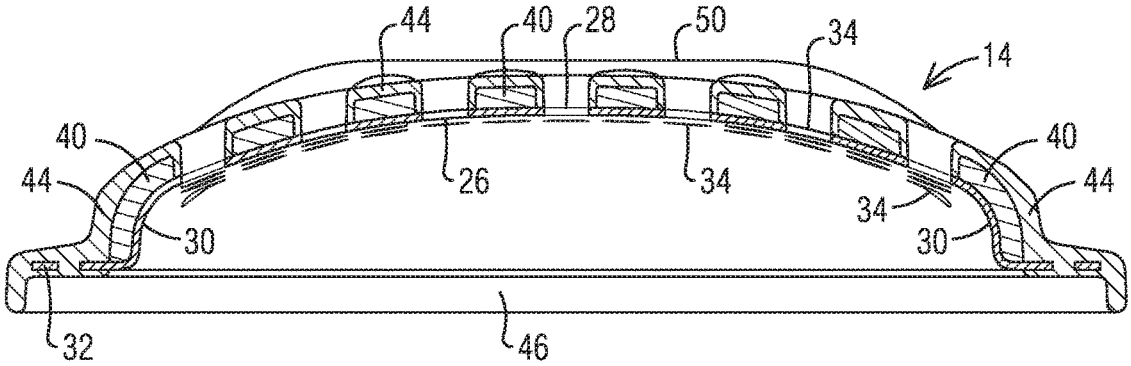
FIG. 5 is a cross-sectional view along line 5-5 of FIG. 4.

As shown in the second embodiment of FIGS. 4 and 5, the cover core 26 may include apertures 34 covering substantially the entire top face 28. As best illustrated in FIG. 5, this arrangement results in numerous tight dimensions and overmolding of cover coating 44 in addition to overmolding of cover susceptor 40, all within confined spaces. While possible to manufacture, this arrangement is not preferred.

FIGS. 1-3 illustrate a different approach, wherein the apertures 34 are localized into specific areas of top face 28, leaving the remaining (relatively large) areas of top face 28 without apertures 34. Various patterns are possible, and in the embodiment shown the apertures 34 are localized in several bands extending laterally across the top face 28, leaving therebetween several bands of continuous top face 28. Further, the overmolding of cover susceptor 40 and cover coating 44 are limited to these areas of continuous top face 28, and there is no overmolding of cover susceptor 40 or cover coating 44 in the bands of apertures. This arrangement is much easier to manufacture, and still provides sufficient susceptor area to heat the cover core 26 as desired.

Similar to the base 12, it is preferred that the cover coating 44 extend to encapsulate the flange 32 to again provide insulated gripping surfaces. The flanges 24 and/or 32 may have areas which extend out further than others, and may act as carrying handles. In the first embodiment, the longitudinal ends are so elongated. Further, as best illustrated in FIG. 3, one of the coatings 42 or 44 may be longer than the other and include a locking flange 46. This will prevent inadvertent shifting of the cover 14 with respect to the base 12.

Encapulating the flanges 24 and 32 with the coatings 42 and 44 will by necessity cause the flanges 24 and 32 to be spaced from each other by the thickness of the combined encapsulations. This is best illustrated in FIG. 3. A first concern with spaced metal parts in a microwave oven is arcing. In the present arrangement the transition from side wall (22 and 30) to flange (24, 32) is a smooth curve, and the spacing between these flanges 24 and 32 is arranged to prevent arcing between base core 18 and cover core 26. A second concern with spaced metal components, when used as shielding, is the size of the space or gap. In the present arrangement, the spacing between base core 18 and cover core 26 is smaller than the microwave wavelength and as such does not compromise the desired shielding of heating chamber 16.

In operation, the device 10 with food product 36 therein will be placed into the microwave oven (not shown) in a upright configuration with base 12 lowest and cover 14 uppermost. This is the initial heating period. Operation of the microwave oven will cause the susceptors 38 and 40 to absorb microwave energy and begin to heat. This will continue until the susceptors 38 and 40 reach their Curie Temperature, at which point they will cease to absorb energy and will start to cool. Upon cooling slightly below the Curie Temperature, the susceptors 38 and 40 will again absorb energy to heat to the Curie Temperature. In this way, the device 10 will be heated to a relatively constant predetermined temperature without the need for any operator input. The heated susceptors 38 and 40 will transfer their heat to the base core 18 and cover core 26, respectively, which will raise the temperature within the heating chamber 16 and thus heat the food product 36.

As the heating chamber 16 and food product 36 are heated, any condensation within the heating chamber or on the food will evaporate as steam (perhaps first becoming liquid if the condensation was frozen). Similarly, the food product 36 may have a high moisture content which is reduced during the heating process, again evaporating as steam. This steam will be able to exit the heating chamber 16 via the plurality of apertures 34. As noted, this will help to crisp or crust the food product 36 during reheating, or maintain proper consistency.

During this period the device 10 will become hot. This heat can transfer to the microwave oven itself by way of the device 10 resting in contact with the oven interior. To reduce this heat transfer and thus protect the microwave oven, it is preferred to provide feet 48 extending downward from the base 12. As may be envisioned, the feet 48 will serve to space the bottom face 20 of base 12 from the oven itself. The feet 48 may be separate members secured to the base 12. In the preferred form shown, the feet 48 are monolithically formed of the base coating 42.

The device 10 will remain in this condition, heating the food product 36 for the desired time. If the food product 36 is raw bread dough, partially prepare bread dough, cake or other similar baked good, then during this period the food product will expand to more fully fill the heating chamber 16. This is illustrated in FIG. 2, where the food product 36 is intended to represent bead partially raised. It is preferred that the device 10 be sized such that the food product 36 be spaced from the cover core 26 during this initial heating period. This will prevent the food product 36 from extending unduly into or through the apertures 34, potentially damaging the food product 36 or blocking the exit of steam. If the food product 36 is a baked good, then similarly upon fully rising the food product would still be spaced from the cover core 26. During this initial heating period the portion of food product 36 in direct contact with the base core 18 will be browned due to the higher heat transfer via conduction. The upper surface of the food product 36 not in contact with either core 18 or 26 typically will not be browned, or browned less than desired. It is preferred, however that when baking the initial heating period will continue until the top of food product 36 has crusted or is otherwise relatively firm. This will prevent the food product 36 from extending unduly into or through the apertures 34.

Figure 6:
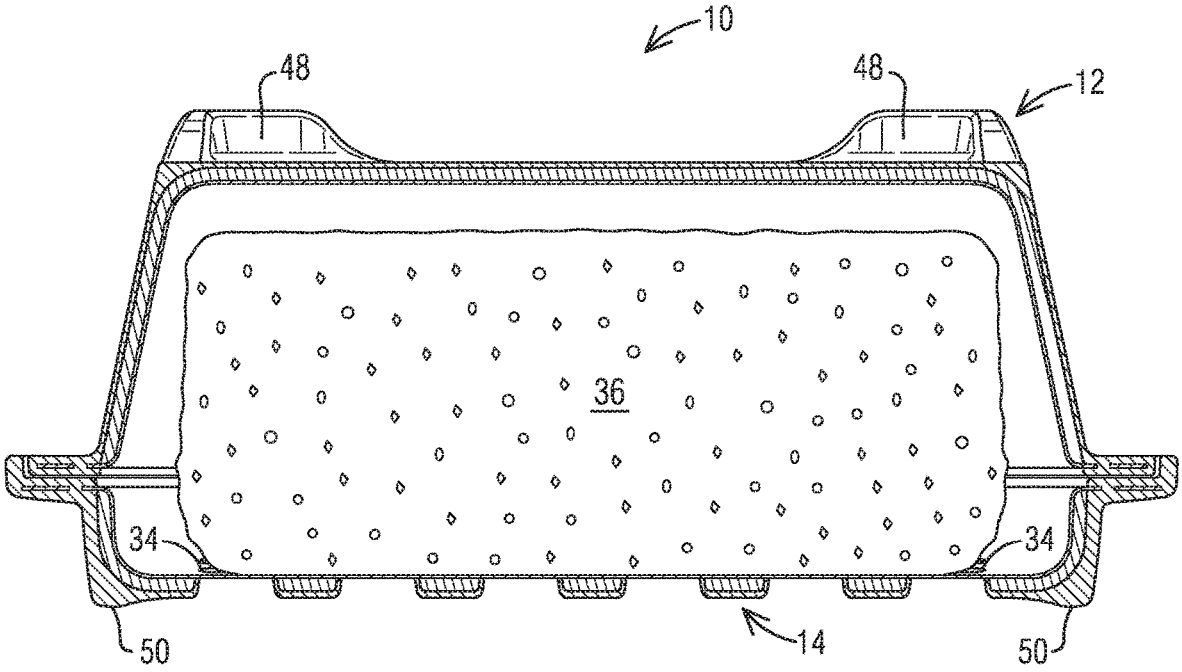
FIG. 6 is a cross-sectional view along line 2-2 of a FIG. 1, with the device inverted.

If the initial heating period were continued until the food product 36 is fully prepared, then the upper surface of the food product 36 would likely not be browned as desired. To overcome this, an inventive feature of the present invention is the inversion of the device 10 for a secondary hearing period. In particular, the user would open the microwave oven, grasp the device 10 and invert it. The device 10 will then rest within the microwave oven as before, but inverted so as to rest upon the cover 14 rather than base 12. In so inverting, the food product 36 will fall within the heating chamber 16, losing contact with the base core 18 and now resting upside down on the cover core 26. This is illustrated in FIG. 6. The user will then activate the microwave oven to begin the secondary heating period. As before, the susceptors 38 and 40 will heat, and transfer their heat respectively to the base core 18 and cover core 26. With the top portion of food product 36 now in contact with cover core 26, this top portion of the food product 36 will be browned due to the increased heat transfer by conduction. The secondary heating period will end upon the time necessary for browning the top of food product 36, or as desired.

During the initial heating period the apertures 34 allowed steam to escape for improved cooking. During the secondary heating period with device 10 inverted, the food product 36 may cover most or all of the apertures 34. This is acceptable. First, the initial and secondary heating periods may be timed such that little if any steam venting is required during the secondary heating period. Second, the apertures 34 may be placed such that it is likely one or more will not be covered by food product 36 when inverted and those apertures 34 will continue to vent as desired. This is illustrated in FIG. 6 where a few apertures 34 remain unblocked. This will allow any desired venting, if required at all.

The embodiments shown in FIGS. 1-6 are directed towards baking, and as such it is preferred that the cover core 26 have a generally domed shape roughly corresponding to the upper surface of the baked food product. This provides increased contact between the cover core 26 and food product 36 when the device 10 is inverted. However, the device 10 would not be stable resting upon a curved cover 14 when inverted. To overcome this, the cover 14 includes one or more supports 50 extending upward from the cover 14 to hold the device 10 stable in the inverted position, just as with feet 48 on the base 12. The supports 50 may be low (not shown), such that the majority of the cover 14 rests upon the microwave oven and the supports 50 merely hold the device 10 stable by eliminating rocking. In the preferred embodiments shown, the supports 50 are higher such that the majority of cover 14, and in particular the portions of cover 14 which include the apertures 34, is spaced from the microwave oven. The supports 50 may be separate members secured to the cover 14. In the preferred form shown, the supports 50 are monolithically formed of the cover coating 44.

It is noted that the aperture 34 will allow crumbs or other dislodged/separated small portions of food product 36 to fall from the device 10 while inverted. This may be minimized by appropriate timing of the initial and secondary heating periods for some foods. Regardless, upon completion of the secondary heating period the user will remove the device 10 from the microwave oven. A period of resting or cooling may be desired prior to opening the device 10 to remove the prepared food product 36. In most cases, the user may desire to invert device 10 once again to its original orientation prior to opening.

Figure 7:
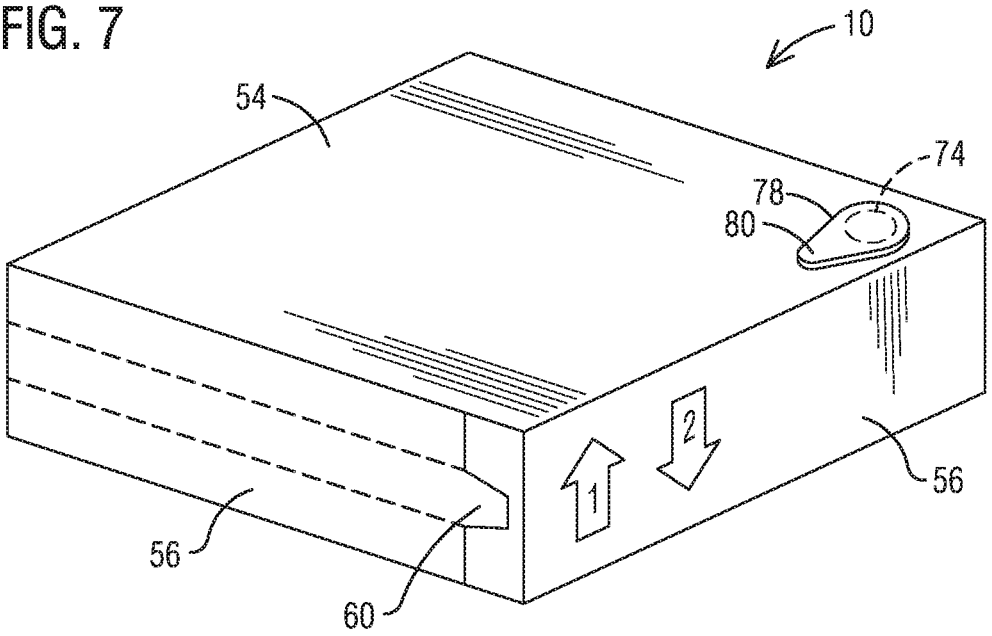
FIG. 7 is a top perspective view of device according to a third embodiment.
Figure 8:
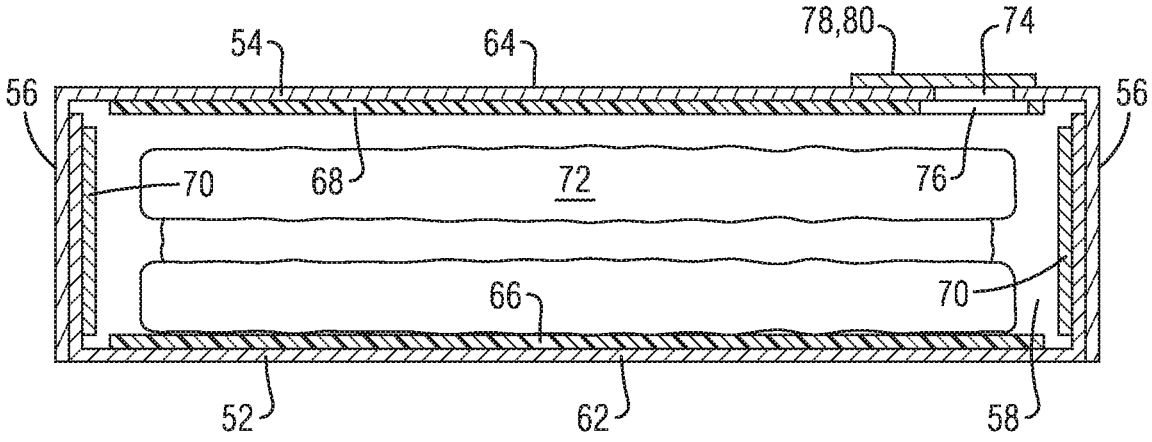
FIG. 8 is a cross-sectional view along line 8-8 of FIG. 7.

This same method of microwave heating may be practiced with differently formed devices 10. A further embodiment of such a device 10 is shown in FIGS. 7 and 8. While the first embodiments were directed towards a durable device 10 for repeated use as kitchen implement, the embodiment of FIGS. 7 and 8 is intended to act as product packaging and a single use reheating device 10. This would typically be for prepackaged frozen food or prepackaged refrigerated food.

With reference to FIGS. 7 and 8, the device 10 takes the general form of a rectangular paper carton including a bottom panel 52, a parallel and spaced top panel 54, and four side panels 56. These panels together define a heating chamber 58. As is common, device 10 will typically be formed from a box blank, with certain side panels 56 being formed of two overlapping tabs secured together. Various other typical food packaging features may be included, such as one of the side panels may include a tear tab 60 for easy opening of the device 10. In this arrangement, the bottom panel 52 and all or a portion of the side panels 56 will define a base 62, and the top panel and possibly the remaining portion of the side panels 56 will define a cover 64.

As before, the base 62 includes a base susceptor 66 and the cover 64 includes a cover susceptor 68. In this embodiment, the base and cover susceptors 66 and 68 are formed as labels adhered to the interior of bottom panel 52 and top panel 54, respectively. Such labels are well known in the art. While the base 62 and cover 64 of this embodiment do not include a metal core for shielding, the susceptors 66 and 68 act as shielding by absorbing nearly all the microwave energy which would pass through the bottom and top panels 52 and 54. The side panels 56 may remain unshielded, or may themselves include shielding 70 adhered thereto as a label, or in the form of a coating on the blank.

The heating chamber 58 will hold a food product 72. The food product 72 may take many forms as before, but may include a meat patty, a shredded potato patty, a filled pastry, etc. In the embodiment shown, the food product 72 is a sandwich having two pieces of bread and a filling, and which is intended to have the bread crisped or browned prior to serving. In this prepackaged food embodiment, the food product 72 may already be browned upon packaging, and the device 10 is intended only to heat the food product 72 and crisp its exterior.

As with the first embodiments, it is preferred that the food product 72 does not initially contact the cover 64. The reason for this is again the desire to vent the heating chamber 58. To this end, the top panel 54 will include one or more apertures 74 extending therethrough. The apertures 74 may be located outside the periphery of the cover susceptor 68. If located within the periphery of cover susceptor 68, then the label forming the cover susceptor 58 will require similar susceptor apertures 76 aligned with apertures 74. In the embodiment of FIGS. 7 and 8 a single aperture 74 and susceptor aperture 76 are provided.

It is typically not desired to have open apertures in a frozen or refrigerated food packages as this can lead to freezer burn, drying, or other spoilage. To avoid these problems, this embodiment includes an aperture seal 78 adhesively secured over the aperture 74. This aperture seal 78 may include an unsecured tab section 80 which may be grasped by a user to manually remove the seal 78 and thus open the aperture 74 for venting. Alternatively, the user may be instructed to pierce the seal 78 for venting.

Operation of this device is similar to that described above. In this case, the device 10 will be factory assembled with food product 72 therein, and thereafter kept frozen or refrigerated as the case may be. When it is desired to heat the food product 72, the user places the device 10 with top panel 54 uppermost and manually removes (or pierces) the aperture seal 78. The device 10 is then placed into a microwave oven, with device 10 resting upon bottom panel 52 and top panel 54 uppermost. The microwave oven is then activated for an initial heating period. As before, this will result in susceptors 66 and 68 heating to the predetermined temperature. This will in turn heat the heating chamber 58 and food product 72. The lower face of the food product in contact with base susceptor 66 may brown or crisp during this initial heating period due to the heat conduction from base susceptor 66.

Upon completion of the initial heating period the microwave oven is opened, and device 10 is inverted and placed in the microwave oven resting upon top panel 54 with bottom panel 52 uppermost. The microwave oven is then activated for a secondary heating period. During inversion of device 10 the upper face of food product 72 will come to rest upon cover susceptor 68. The upper face of the food product in contact with cover susceptor 66 may brown or crisp during this secondary heating period, again due to higher heat transfer via conduction. Upon completion of the secondary heating period there may be a period of cooling or rest. The user may then open the device 10 (such as by tear tab 60) to remove the prepared food product 72.

From the foregoing it will be seen that this invention is one well adapted to attain all ends and objects set forth above together with the other advantages which are inherent within its structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth of shown in the accompanying drawings is to be interpreted as illustrative, and not in a limiting sense.

What is claimed is:

1. A device for microwave heating with inversion, comprising:

a base and a cover, together defining a heating chamber;

a base susceptor mounted on said base, and a cover susceptor mounted on said cover, both said susceptors converting microwave energy into thermal energy;

wherein said cover includes at least one aperture for venting steam from said heating chamber, wherein an outermost layer of the cover defining a top surface of the cover defines the at least one aperture in said top surface, and the at least one aperture extends through the cover to the heating chamber;

wherein said cover comprises either a planar top panel as the outermost layer or has a plurality of supports extending from the outermost layer, both of which support the device in a stable manner in an inverted position in which the cover is below the base.

2. The device for microwave heating with inversion as in claim 1, wherein said at least one aperture comprises multiple said apertures; said apertures being confined to certain areas of said cover, with remaining areas of said cover having no said apertures; and said cover susceptor is located only in those remaining areas.

3. The device for microwave heating with inversion as in claim 2, wherein said at least one aperture comprises multiple said apertures; said apertures being confined to certain areas of said cover, with remaining areas of said cover having no said apertures; and said cover susceptor is located only in those remaining areas.

4. The device for microwave heating with inversion as in claim 1, wherein said base includes a metal base core and said base susceptor is mounted to said base core on the side opposite food contact; and said cover includes a metal cover core and said cover susceptor is mounted to said cover core on the side opposite food contact.

5. The device for microwave heating with inversion as in claim 1, wherein the outermost layer is an over-molded cover coating.

6. The device for microwave heating with inversion as in claim 5, wherein said over-molded cover coating is over-molded to said cover susceptor and an outwardly, radially extending flange of a cover core.

7. The device for microwave heating with inversion as in claim 6, wherein said cover core defines a plurality of secondary apertures aligned one each with a plurality of the at least one aperture in the outermost layer of the cover and in the cover susceptor.

8. The device for microwave heating with inversion as in claim 7, wherein said plurality of secondary apertures each have an opening size smaller than the wavelength of microwaves.

9. The device for microwave heating with inversion as in claim 6, wherein said cover core defines a plurality of secondary apertures, and said plurality of secondary apertures align with one of said at least one aperture.

10. The device for microwave heating with inversion as in claim 9, wherein said plurality of secondary apertures each have an opening size smaller than the wavelength of microwaves.

11. The device for microwave heating with inversion as in claim 1, wherein said at least one aperture is located outside the periphery of the cover susceptor.

12. The device for microwave heating with inversion as in claim 11, wherein said outermost layer is a box blank.

13. The device for microwave heating with inversion as in claim 1, wherein said at least one aperture is located within the periphery of the cover susceptor in alignment with a susceptor aperture.

14. The device for microwave heating with inversion as in claim 13, wherein said outermost layer is a box blank.

15. The device for microwave heating with inversion as in claim 14, wherein said box blank is a paper carton.

16. A method for microwave heating with inversion, comprising the step of:

providing a device having: a base and a cover, together defining a heating chamber;

a base susceptor mounted on said base, and a cover susceptor mounted on said cover, both said susceptors converting microwave energy into thermal energy; wherein said cover includes at least one aperture for venting steam from said heating chamber, wherein an outermost layer of the cover defining a top surface thereof defines the at least one aperture in said top surface, and the at least one aperture extends through the cover to the heating chamber, wherein said cover comprises either a planar top panel as the outermost layer or has a plurality of supports extending from the outermost layer, both of which support the device in a stable manner in an inverted position in which the cover is below the base;

placing a food product within said heating chamber;

subjecting said device to microwave energy for an initial heating period with said device resting upon said base;

inverting said device to rest upon said cover;

subjecting said device to microwave energy for a secondary heating period.

* * * * *